US005938039A

United States Patent [19]

Liu

[11] Patent Number: 5,938,039

[45] Date of Patent: Aug. 17, 1999

[54] TERMINAL STRIP PACKING ARRANGEMENT

[75] Inventor: Chao-Zen Liu, Tao-Yuan Hsien, Taiwan

[73] Assignee: Speed Tech Corp., Tao-Yuan Hsien, Taiwan

[21] Appl. No.: 09/116,304

[22] Filed: Jul. 15, 1998

[30] Foreign Application Priority Data

Jul. 19, 1997 [TW] Taiwan ..... 86212103

[51] Int. Cl.[6] ..... B65D 85/86

[52] U.S. Cl. ..... 206/717; 29/884; 439/885

[58] Field of Search ..... 206/701, 713, 206/717; 29/884; 439/885

[56] References Cited

U.S. PATENT DOCUMENTS 4,616,416 10/1986 Cabaud ..... 29/884

5,060,372 10/1991 Capp et al. ..... 439/885

5,860,821 1/1999 Pernet ..... 439/885

5,867,895 2/1999 Van Beneden et al. ..... 29/884

*Primary Examiner*—Jim Foster

*Attorney, Agent, or Firm*—Pro-Techtor International Services

[57] ABSTRACT

A terminal strip packing arrangement including two insulative packing sheets and a terminal strip sandwiched in between the insulative packing sheets and rolled up with them into a roll for storage, wherein the terminal strip has an auxiliary strip integral with linked terminals thereof at one side, the auxiliary strip having outwardly extended protective arms adapted to stop against the insulative packing sheets to protect curved tails of the linked terminals from being compressed by the insulative packing sheets during storage.

5 Claims, 2 Drawing Sheets

TERMINAL STRIP PACKING ARRANGEMENT

BACKGROUND OF THE INVENTION

The present invention relates to a terminal strip packing arrangement, and more particularly to such a terminal strip packing arrangement in which the terminal strip has protective arms for protecting the curved tails of the linked terminals against a compressive force.

When a terminal strip is made, it is stamped into a row of links terminals, and then sandwiched in between two insulative packing sheets and rolled up with them into a roll for storage before an use. Because the terminals of the terminal strip have curved tails projecting from one or both sides of the terminal strip, the curved tails of the terminals tend to be compressed and deformed during storage or delivery of the package.

SUMMARY OF THE INVENTION

The present invention has been accomplished to provide a terminal strip packing arrangement which eliminates the aforesaid problem. According to the preferred embodiment of the present invention, the terminal strip has an auxiliary strip integral with its linked terminals at one side. The auxiliary strip has outwardly extended protective arms adapted to stop against the insulative packing sheets to protect curved tails of the linked terminals from being compressed by the insulative packing sheets during storage or delivery of the package.

DETAILED DESCRIPTION OF THE PREFERRED EMBODIMENT

Figure 2:
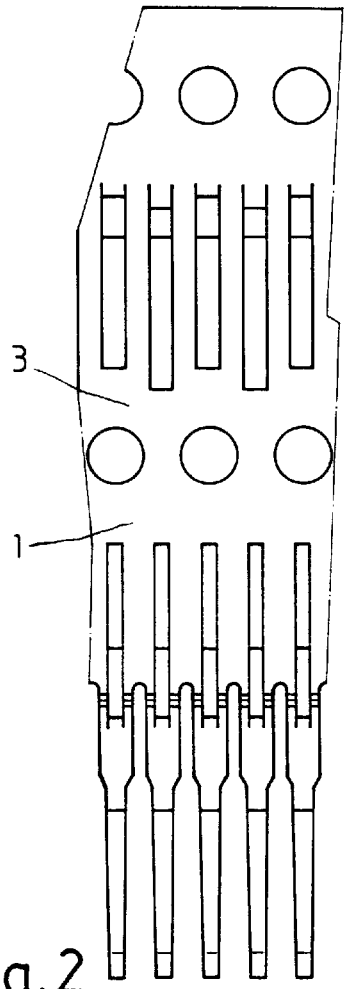
FIG. 2 is a front plain view of the terminal strip shown in FIG. 1.
Figure 3:
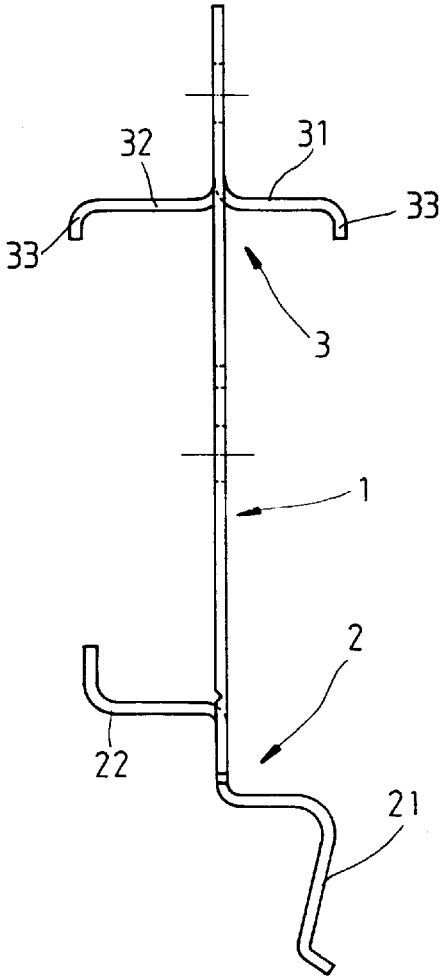
FIG. 3 is a side view of the terminal strip shown in FIG. 1.
Figure 1:
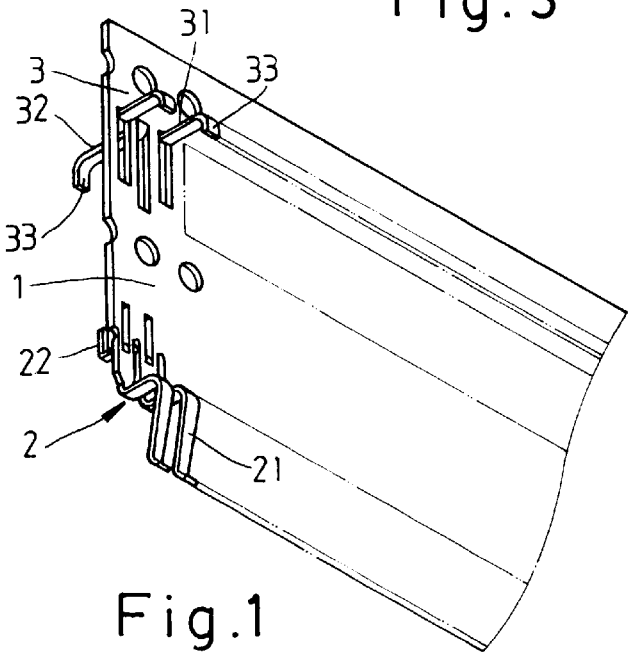
FIG. 1 is a perspective view of a terminal strip according to one embodiment of the present invention.

Referring to Figures from 1 to 3, a terminal strip in accordance with the present invention is comprised of a base strip 1 stamped into a row of linked terminals 2, and an auxiliary material strip 3 integral with the base strip 1 at one side on the same plane and stamped into a plurality of first protective arms 31 and second protective arms 32. The first protective arms 31 and the second protective arms 32 are alternatively extended outwards from two opposite sides of the auxiliary strip 3 in reversed directions at equal distance. The terminals 2 of the base strip 1 have respective curved tails 21;22 alternatively extended outwards from two opposite sides of the base strip 1 in reversed directions. The first and second protective arms 31;32 have a respective end terminating in a respective downward stop plane 33. The transverse length of the projective arms 31;32 in direction perpendicular to the auxiliary strip 3 is relatively longer than the transverse lengths of the curved tail 21;22 in perpendicular direction from the base strip 1.

Figure 5:
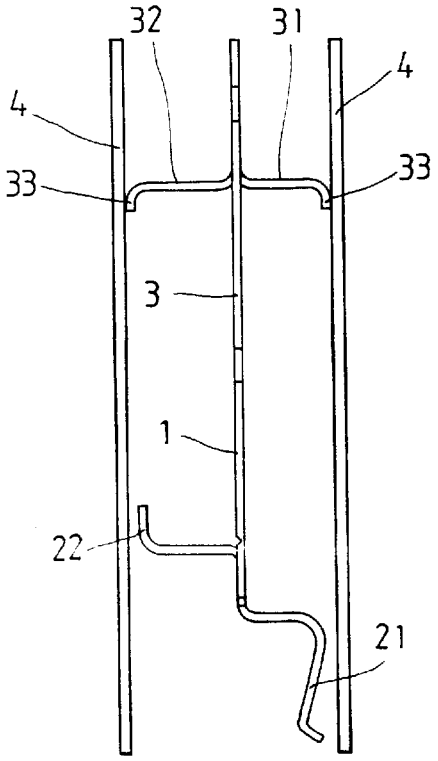
FIG. 5 is a side view of FIG. 4.
Figure 4:
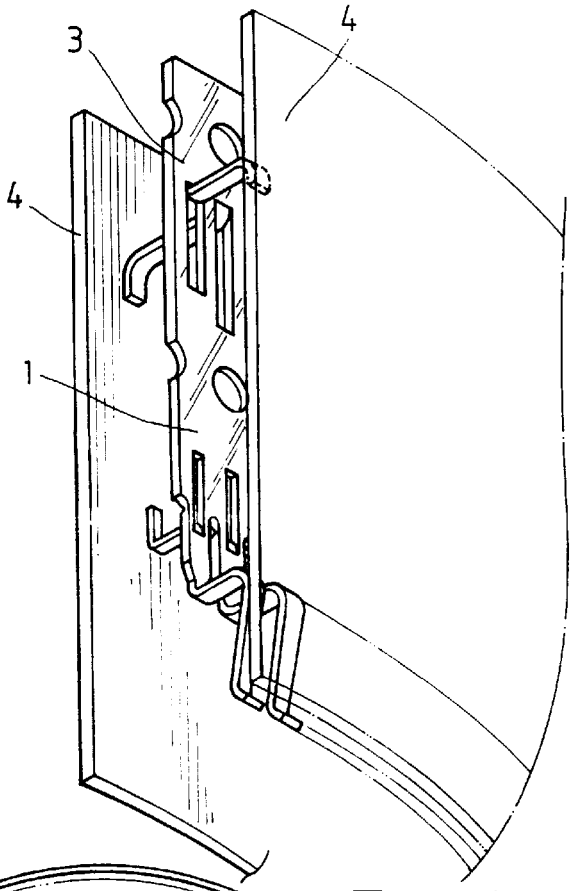
FIG. 4 shows the terminal strip sandwiched in between two insulative packing sheets.
Figure 6:
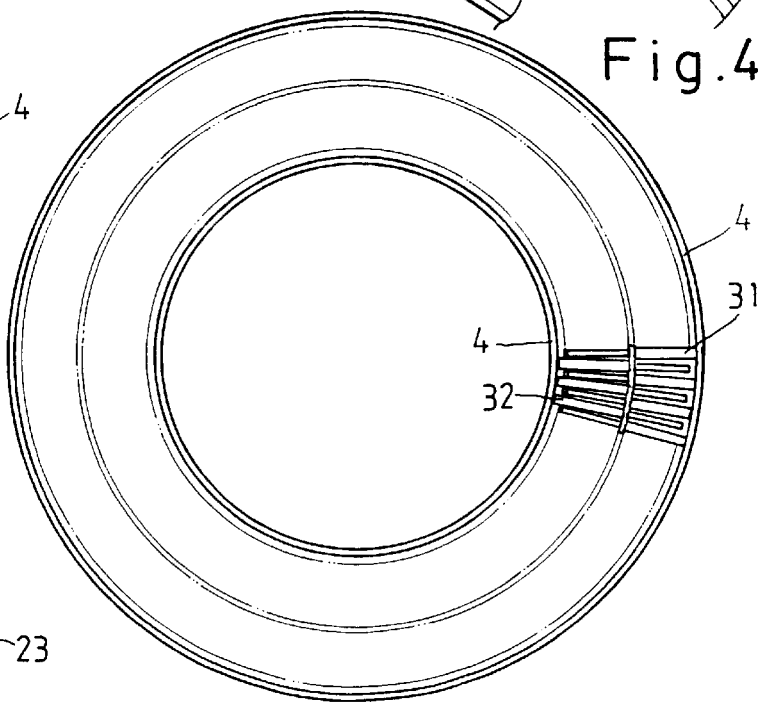
FIG. 6 shows the terminal strip and the insulative packing sheets rolled up into a roll according to the present invention.

Referring to Figures from 4 to 6, the terminal strip 1;3 is sandwiched in between two insulative packing sheets 4 (see FIGS. 4 and 5), and then rolled up into a roll for storage with less space occupation (see FIG. 6). When the terminal strip 1;3 is sandwiched in between the insulative packing sheets 4, the downward stop planes 33 of the first and second protective arms 31;32 are respectively stopped against the insulative packing sheets 4 to prohibit the curved tails 21;22 of the terminals 2 from being compressed (see FIG. 5).

Figure 7:
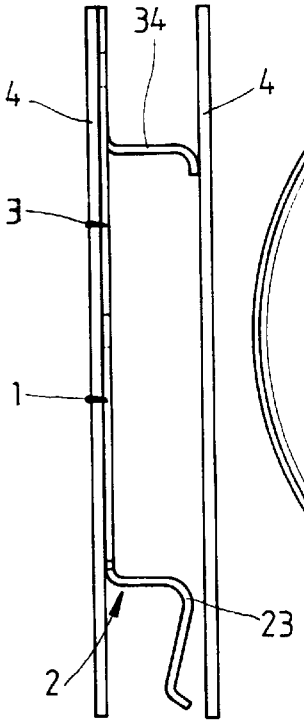
FIG. 7 is a side view of an alternate form of the present invention.

FIG. 7 shows an alternate form of the present invention, in which the terminal strip 1;3 is closely attached to an inner side of one insulative packing sheet 4, the terminals 2 of the base strip 1 have a respective curved tail 23 respectively extended from its one side in the same direction; the auxiliary strip 3 have a plurality of protective arms 34 extended from its one side and respectively suspending above the curved tails 23 of the terminals 2 and stopped against one insulative packing sheet 4.

What the invention claimed is:

1. A terminal strip packing arrangement comprising two insulative packing sheets and a terminal strip sandwiched in between said insulative packing sheets and rolled up with them into a roll for storage, said terminal strip comprising a base strip stamped into a row of linked terminals, said linked terminals having a respective curved tail respectively extended outwards from at least one side of said terminal strip, wherein said terminal strip comprises an auxiliary strip integral with one side of its base strip on the same plane and stamped into a plurality of protective arms, said protective arms respectively extended outwards from at least one side of said auxiliary strip and respectively suspending above said curved tails of said terminals and respectively stopped against at least one of said insulative packing sheet to protect said curved tails of said terminals from being compressed by said insulative packing sheets.

2. The terminal strip packing arrangement of claim 1, wherein said protective arms have a respective end terminating in a respective downward stop plane stopped against one insulative packing sheet.

3. The terminal strip packing arrangement of claim 1, wherein said protective arms have an equal length and each of said protective arms projects from one side of said auxiliary strip at a longer distance than the projecting distance of each of said curved tails from one side of said base strip in perpendicular direction relative to said base strip.

4. The terminal strip packing arrangement of claim 1, wherein said curved tails of said terminals are alternatively extended from two opposite sides of said base strip in reversed directions; said protective arms are alternatively extended from two opposite sides of said auxiliary strip in reversed directions.

5. The terminal strip packing arrangement of claim 1, wherein said curved tails of said terminals are respectively extended from one side of said base strip in one direction; said protective arms are respectively extended from one side of said auxiliary strip in one direction corresponding to said curved tails of said terminals.

* * * * *